US007144286B2

(12) United States Patent
Ishizuka et al.

(10) Patent No.: US 7,144,286 B2
(45) Date of Patent: Dec. 5, 2006

(54) METHOD OF MANUFACTURING COLD CATHODE TYPE ELECTRON EMITTING DEVICE

(75) Inventors: Yoshiki Ishizuka, Tokyo (JP); Katsuyoshi Fukuda, Yokosuka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 161 days.

(21) Appl. No.: 10/725,509

(22) Filed: Dec. 3, 2003

(65) Prior Publication Data

US 2004/0245906 A1 Dec. 9, 2004

(30) Foreign Application Priority Data

Jun. 9, 2003 (JP) ..... 2003-163861

(51) Int. Cl.
*H01J 9/00* (2006.01)

(52) U.S. Cl. ..... 445/23

(58) Field of Classification Search ..... 445/23–25, 445/50, 51

See application file for complete search history.

(56) References Cited

U.S. PATENT DOCUMENTS

2002/0057046 A1 5/2002 Yamamoto et al.
2003/0227251 A1 12/2003 Ishizuka

FOREIGN PATENT DOCUMENTS

JP 11-40044 2/1999
JP 11-297192 10/1999
JP 2000-243248 9/2000

OTHER PUBLICATIONS

Bischoff, M. et al., "Energy Distribution of Emitted Electrons From Electroformed MIM Structures: The Carbon Island Model", Int. J. Electronics, vol. 73, No. 5, pp. 1009-1010, (1992), no month.
Bischoff, M., "Carbon-Nanoslit Model For the Electroforming Process in M-I-M Structures", Int. J. Electronics, vol. 70, No. 3, pp. 491-498, (1991), no month.
Pagnia, H. et al., "Scanning Tunnelling Microscopic Investigations of Electroformed Planar Metal-Insulator-Metal Diodes", Int. J. Electronics, vol. 69, No. 1, pp. 25-32, (1990): no month.
Pagnia, H., "Metal-Insulator-Metal Devices With Carbonaceous Current Paths", Int. J. Electronics, vol. 69, No. 1, pp. 33-42, (1990), no month.
Pagnia, H. et al., "Bitable Switching in Electroformed Metal-Insulator-Metal Devices", Review Article: Phys. Stat. Sol. (a)108, 11, pp. 11-65, (May 3, 1988).
Notification of Reasons for Rejection, issued by the Japanese Patent Office, mailed Jun. 14, 2005, in Japanese Patent Application No. 2003-163861, and English-language translation thereof.

*Primary Examiner*—Joseph Williams
(74) *Attorney, Agent, or Firm*—Finnegan, Henderson, Farabow, Garrett & Dunner, L.L.P.

(57) ABSTRACT

A method of manufacturing a cold cathode type electron emitting device includes forming a pair of electrodes, which are spaced from each other, on a substrate, forming conductive thin films, which are electrically connected with the pair of electrodes and have a cracked portion therebetween, on a space between the pair of electrodes, forming conductive deposits on the cracked portion of the conductive thin films to form an electron emission section, and subjecting the electron emission section to a treatment using plasma to expand a gap between the conductive deposits on the cracked portion.

12 Claims, 3 Drawing Sheets

METHOD OF MANUFACTURING COLD CATHODE TYPE ELECTRON EMITTING DEVICE

CROSS-REFERENCE TO RELATED APPLICATIONS

This application is based upon and claims the benefit of priority from the prior Japanese Patent Application No. 2003-163861, filed Jun. 9, 2003, the entire contents of which are incorporated herein by reference.

BACKGROUND OF THE INVENTION

1. Field of the Invention

The present invention relates to a cold cathode type electron emitting device which can be applied to a display device, an exposure apparatus, etc., to the method of manufacturing the cold cathode type electron emitting device and to the method of driving the cold cathode type electron emitting device.

2. Description of the Related Art

A cold cathode type electron emitting device having a planar structure has been conventionally known. The electron emitting devices called a surface conduction type or planar type MIM device are such that they are provided with a pair of device electrodes which are formed on a flat insulating substrate and spaced away from each other by a predetermined distance, and also with an electron emitting portion positioned on a thin film which is interposed between these device electrodes. Since these electron emitting devices are simple in structure, they are suited for use in constructing, for example, an electron source array which is constituted by a large number of electron emitting devices formed on the same substrate.

It is now attracting much attention, as one example of the application of such an electron source array, to fabricate a thin planar display. The principle of luminescence thereof is the same as that of CRT, i.e., the electronic excitation of fluorescent substance is utilized. Since this thin planar display is excellent in energy efficiency, it is possible to realize a self-emission type thin planar display of low power consumption, high luminance, and high contrast.

There is known, as an example of the planar type MIM device, a device where a pair of gold electrodes are formed on a substrate and a discontinuous gold film is formed between this pair of gold electrodes. The device of this structure can be manufactured by the following procedures. First of all, a pair of planar gold electrodes are formed on an insulating substrate. Then, a gold thin film having a sufficient thickness for permitting an electrical conduction between these gold electrodes is formed. Thereafter, an electric current is permitted to flow between these gold electrodes to generate Joule heat, thereby causing the gold thin film to fuse and be destroyed, thus cracking the gold thin film and obtaining a discontinuous gold film. The gold film immediately after this discontinuation is high in electrical resistance. The procedures for effecting the discontinuation of a thin film through the application of an electric current is called "B forming (basic forming)".

The structure obtained in this manner is then subjected to a procedure called "A forming (adsorption assist forming)". This assist forming is performed by applying a voltage of 20V or less to the device in a very low pressure atmosphere containing hydrocarbons. As a result, due to the action of high electric field generated in the discontinuous film, the electrical resistance of the device is enabled to decrease within a several minutes, thus making it possible to increase the electric current of the device.

It is reported in Pagnia, Int. J. Electronics, 69(1990) 25, and in Pagnia, Int. J. Electronics, 69(1990) 33 that the region between the gold electrodes of the device after the application of the aforementioned A forming is entirely covered with a conductive film. This conductive film is a film containing carbon.

Further, under a condition where a third electrode (anode) is disposed opposite to the device, when electric current flows through the device and at the same time, a positive voltage is applied to the third electrode, current flow between these electrodes can be observed and at the same time, current flow between the device and the third electrode can be observed. If the current flow between these electrodes is defined as an device current and the current flow between the device and the third electrode is defined as an emission current, the ratio of the emission current to the device current (emission efficiency) is extremely small, i.e. $1\times10^{-4}$% or so (see for example, Pagnia, Phys. Stat. Sol. (a) 108(1988) 11).

On the other hand, the surface conduction type device has a structure which is similar to the aforementioned planar type MIM device. In the example that has been reported (see for example, JP Laid-open Patent Publication (Kokai) No. 11-297192(1999)), the surface conduction type device is formed through a process wherein the device is subjected to a step of the aforementioned "forming" in the same manner as the aforementioned planar type MIM device to thereby form an electrically discontinuous portion in the conductive thin film which has been formed between a pair of electrodes, and then subjected to a step of activation to thereby permit a deposit layer containing carbon to be deposited on the surface of the conductive thin film. Incidentally, in the example described in JP Laid-open Patent Publication (Kokai) No. 11-297192(1999), a voltage is applied between the device and anode to generate plasma, thereby performing the cleaning of the conductive thin film.

An image display device can be fabricated through a procedure wherein a large number of the aforementioned surface conduction type devices are arrayed and phosphors are respectively disposed opposite to each of the devices. The brightness which is one of the important display characteristics of an image display device is dependent on the luminescence intensity of the phosphors, but is also positively correlated with the emission of electric current. Namely, even if the emission efficiency is constant, if the device current is increased, it is possible to increase the emission current, so that if it is desired to increase the emission current, it will be realized by increasing the device current. If it is desired to increase the device current, it will be realized by increasing the size of the device. However, in view of the image resolution, the increase in size of the device is limited, and additionally, there is an upper limit with respect to the density of device current from the viewpoint of the thermal stability of the device.

Incidentally, a voltage is applied also to the aforementioned "cracked portion" which is an electrically discontinuous portion. Therefore, there is also a limitation with regard to the voltage in order to retain a predetermined degree of electric field so as to prevent the cracked portion from generating an electric discharge. This limitation is also effective for limiting the upper limit of the current density.

It will be understood from the foregoing explanation that it is imperative to increase the emission efficiency in order to increase the emission current.

BRIEF SUMMARY OF THE INVENTION

An object of the present invention is to provide a method of manufacturing a cold cathode type electron emitting device which is capable of increasing the emission current through improvements of the emission efficiency.

According to one aspect of the present invention, there is provided a method of manufacturing a cold cathode type electron emitting device, comprising: forming a pair of electrodes, which are spaced from each other, on a substrate; forming conductive thin films, which are electrically connected with the pair of electrodes and have a cracked portion therebetween, on a space between the pair of electrodes; forming conductive deposits on the cracked portion of the conductive thin films to form an electron emission section; and subjecting the electron emission section to a treatment using plasma to expand a gap between the conductive deposits on the cracked portion.

According to another aspect of the present invention, there is provided a cold cathode type electron emitting device comprising: a pair of electrodes spaced from each other and formed on a substrate; conductive thin films formed on a space between the pair of electrodes, the conductive thin film being electrically connected with the pair of electrodes and having a cracked portion therebetween; and electron emission section formed of conductive deposits formed on the cracked portion of the conductive thin film; wherein a gap between the conductive deposits on the cracked portion of the electron emission section is extended through a treatment using plasma.

According to a further aspect of the present invention, there is provided a method of driving a cold cathode type electron emitting device described above, wherein the cold cathode type electron emitting device is driven using a driving voltage which is higher than a maximum voltage to be employed in a manufacturing process of the cold cathode type electron emitting device.

DETAILED DESCRIPTION OF THE INVENTION

Figure 1:
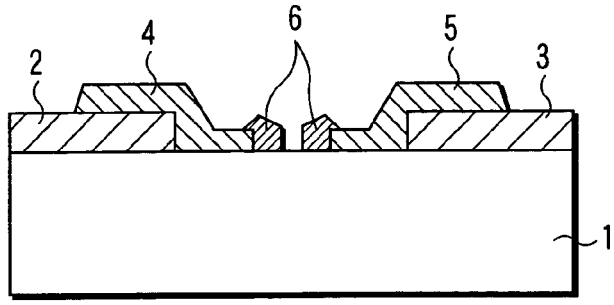
FIG. 1 is a front view schematically illustrating the structure of a planar type electron emission device according to one embodiment of the present invention.

There will now be described various embodiments of the present invention.

In one of the embodiments of the present invention, the following measures have been taken for overcoming the aforementioned problems.

First, the upper limit of the voltage to be applied to a device can be raised by expanding the gap of the electron emission section (cracked portion) of the conductive thin film which have been formed between a pair of the electrodes. As a result, as explained hereinafter, it becomes possible to extend the range of operating voltage of the device, thus making it possible to improve the emission efficiency. The method employed to expand the gap of the cracked portion is a treatment or an etching treatment using a plasma after forming the device (after the activating process). The examples of the etching treatment are reactive ion etching (RIE) and chemical dry etching (CDE).

Neither reactive ion etching (RIE) nor chemical dry etching (CDE) is intended to generate a plasma through the application of voltage between the device and the anode as seen in the cleaning treatment which is described in Pagnia, Int. J. Electronics, 69(1990). Namely, the reactive ion etching (RIE) is an etching treatment wherein high-frequency is applied between parallel plate electrodes to generate a plasma, thereby allowing the device disposed on one of the electrodes to be exposed to the charged particles to perform the etching of the cracked portion. On the other hand, the chemical dry etching (CDE) is an etching treatment wherein a plasma is generated in a chamber which is separate from the chamber where the device is disposed, thereby permitting the cracked portion to chemically react with radicals of small kinetic energy, thus performing the etching of the cracked portion. In any of these etching treatments, there is little possibility that the device is damaged by the electric discharge and the expansion of the gap of the cracked portion can be effectively achieved.

With respect to the magnitude of expansion of the gap of the cracked portion, which is to be executed by way these etching treatments, there is not any particular limitation. However, it would be possible to obtain a desirable effect by expanding the gap by a magnitude of about 0.5 to 10.0 nm in general.

As for the gas source for the plasma, although it is possible to employ $N_2$ gas, the employment of gas containing a halogen compound is advantageous in the respect that carbon-halogen bond can be locally provided to the surface of the cracked portion, thereby making it possible to stabilize the surface of the device.

In the cold cathode type electron emitting device, the emission and reception of electrons would take place in the electron emission section (cracked portion) of the conductive thin film formed between the electrodes. In this case, however, if the surface condition of the cracked portion is non-uniform, the irregularity of current density would be caused to generate. If so, there is much possibility that, due to delicate fluctuations of the driving conditions of the device, electric discharge may be caused to occur at the region where electric current is liable to locally flow through. Specific examples of such delicate fluctuations of the driving conditions of the device include the fluctuations of driving voltage. In particular, as described above, when the voltage to be applied is increased, the margin with regard to the electric discharge is decreased, thereby raising the problem of the destruction of the device due to such delicate fluctuations.

Whereas, when a gas containing a halogen compound is employed as a gas source for the plasma in the etching treatment, the surface of the device would be stabilized, thereby making it possible to obviate such problems. As for the halogen compounds useful in this case, it is possible to employ chloromethane such as carbon tetrachloride ($CCl_4$), chloroform ($CHCl_3$), methylene chloride ($CH_2Cl_2$), trichloroethylene ($C_2HCl_3$) and tetrachloroethylene ($C_2Cl_4$); fluoromethane such as carbon tetrafluoride ($CF_4$), trifluoromethane ($CHF_3$), methylene fluoride ($CH_2F_2$) and tetrafluoroethylene ($C_2F_4$); chlorofluorocarbon containing plural kinds of halogen atoms such as $CCl_3F$, $CCl_2F_2$, etc.; chlorofluorocarbon additionally containing hydrogen atom such as $CF_3CHCl_2$ and $CF_3CH_2Cl$; and halon such as $CBrClF_2$ and $CBrF_3$.

The formation of a stable layer on the surface of the device in the etching treatment using a gas containing the aforementioned halogen compounds can be confirmed by performing the analysis of the state of bonding between atoms by making use of XPS, for example. Incidentally, when $CF_4$ was employed as a halogen compound in the etching, it was possible to confirm the bonds such as C—F, C—$F_2$ and C—$F_3$.

Next, the embodiments of the present invention will be explained with reference to drawings.

First of all, the fundamental structure and manufacturing method of the electron emission device according to one embodiment of the present invention will be explained.

Figure 2:
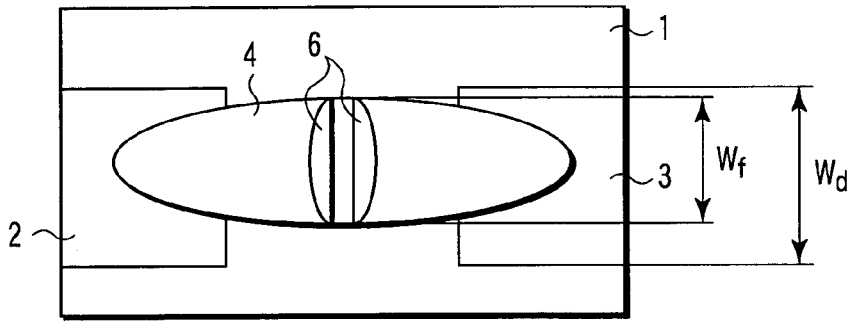
FIG. 2 is a plan view schematically illustrating the structure of a planar type electron emission device according to one embodiment of the present invention.

FIGS. 1 and 2 illustrate schematically the structure of a planar electron emission device according to one embodiment of the present invention, wherein FIG. 1 is a front view and FIG. 2 is a plan view. In FIGS. 1 and 2, a pair of device electrodes 2 and 3 are formed on a substrate 1. Further, conductive thin films 4 and 5 are formed on and between these device electrodes 2 and 3. Additionally, deposits 6 are formed between the conductive thin films 4 and 5. The deposits 6 are electrically connected with the conductive thin films 4 and 5, respectively, and at the same time, electrically separated from each other due to the cracking forming the electron emission section.

In the planar electron emission device which is constructed as described above, the substrate 1 can be made of an insulating material or a highly resistant material. For example, the substrate 1 may be formed of a substance containing $SiO_2$ as a main component such as quartz glass, quartz, sodium glass, soda-lime glass, borosilicate glass, phosphorus glass, etc.; an insulating oxide such as $Al_2O_3$, etc.; and a nitride insulating substance such as AlN. These materials can be optionally selected by taking the factors such as profitability and productivity into consideration.

The substrate 1 should preferably be constructed such that it has, in the vicinity of the surface thereof, a withstand voltage of $10^7$V/cm or more. Therefore, it is required that a mobile ion species such as $Na^+$ ion is removed in advance from the vicinity of the surface of the substrate 1. Accordingly, if a material containing a mobile ion species such as sodium glass is to be employed, it is preferable to form a diffusion preventive layer such as a SiN layer on the surface thereof and further to form a surface layer such as an $SiO_2$ film on the surface of the diffusion preventive layer.

The device electrodes 2 and 3 to be formed on the substrate 1 can be formed of conductive metals, semiconductors or semi-metallic materials. It is more preferable to employ transition metals which are excellent in conductivity and in oxidation resistance, specific examples thereof including Ni, Au, Ag, Pt and Ir.

The thickness of the device electrodes 2 and 3 may preferably fall within the range of several hundreds angstroms to several micrometers to be excellent in conductivity. Further, the device electrodes 2 and 3 may preferably be uniform in thickness and be free as much as possible from peeling, swelling and partial peeling.

The device electrodes 2 and 3 can be obtained by forming a thin film on the substrate 1 and patterning the thin film to form the device electrodes 2 and 3. As for the method of forming the thin film on the substrate, it is possible to optionally select from vacuum vapor phase deposition, plating, precipitation from a colloid solution, etc. When the adhesion of the thin film to the substrate is poor, it may be advisable to make the surface of the substrate into a rugged surface of nano-scale, or to preliminarily form a layer of a second material (not shown) which can be employed as an adhesion layer between the substrate and the thin film.

As for the method of patterning the thin film, it is possible to optionally select from a vapor deposition using a mask, a patterning using a resist pattern as a mask, lift-off method, screen printing, offset printing, etc. It is more preferable to employ a method where the peeling of edge portions of the thin film can hardly occur.

As for the materials for the conductive thin films 4 and 5 which are designed to be formed on and between the device electrodes 2 and 3, it is possible to select from metals, semiconductors or semi-metallic materials as in the case of the device electrodes 2 and 3. It is preferable to employ catalytic transition metals such as Ni, Co, Fe, Pd, Au, Pt and Ir. However, the materials for the conductive thin films 4 and 5 are not limited to these transition metals.

The thickness of the conductive thin films 4 and 5 may preferably be so thin that it may become discontinuous but it is sufficiently thick to ensure the electric conductance thereof.

The conductive thin films 4 and 5 are generally obtained by initially forming a continuous film and then electrically cutting off using an electric heating to separate them from each other. As for the method of forming a continuous film for forming these conductive thin films 4 and 5, it is possible to select from vacuum deposition such as sputtering, CVD, MBE, laser abrasion, etc.; plating; the precipitation thereof from a colloid solution; the precipitation of self-organized film by making use of metal/semiconductor ultra-fine particles the surfaces of which are stabilized with organic molecules such as alkanethiol.

The widths Wd and Wf of the device electrodes 2 and 3 and the conductive thin film are determined depending on the magnitude of emitting electric current required and on the area of occupancy permitted for the device. The widths Wd and Wf may be about 1 mm for instance. Further, the distance Dg between device electrodes may be optionally determined based on various factors such as the patterning method that can be utilized, the tolerance of the fluctuations in properties among the devices. For example, the distance Dg may be set to fall within the range of several tens nanometers to several tens micrometers.

The deposits 6 to be formed between the conductive thin films 4 and 5 may be formed through a process wherein electric current flows between the device electrodes 2 and 3 to thereby drive the device in an atmosphere containing a gas as a raw material for forming the deposits, thereby forming the deposits. The followings are explanation of the method of forming the deposits 6.

Figure 3:
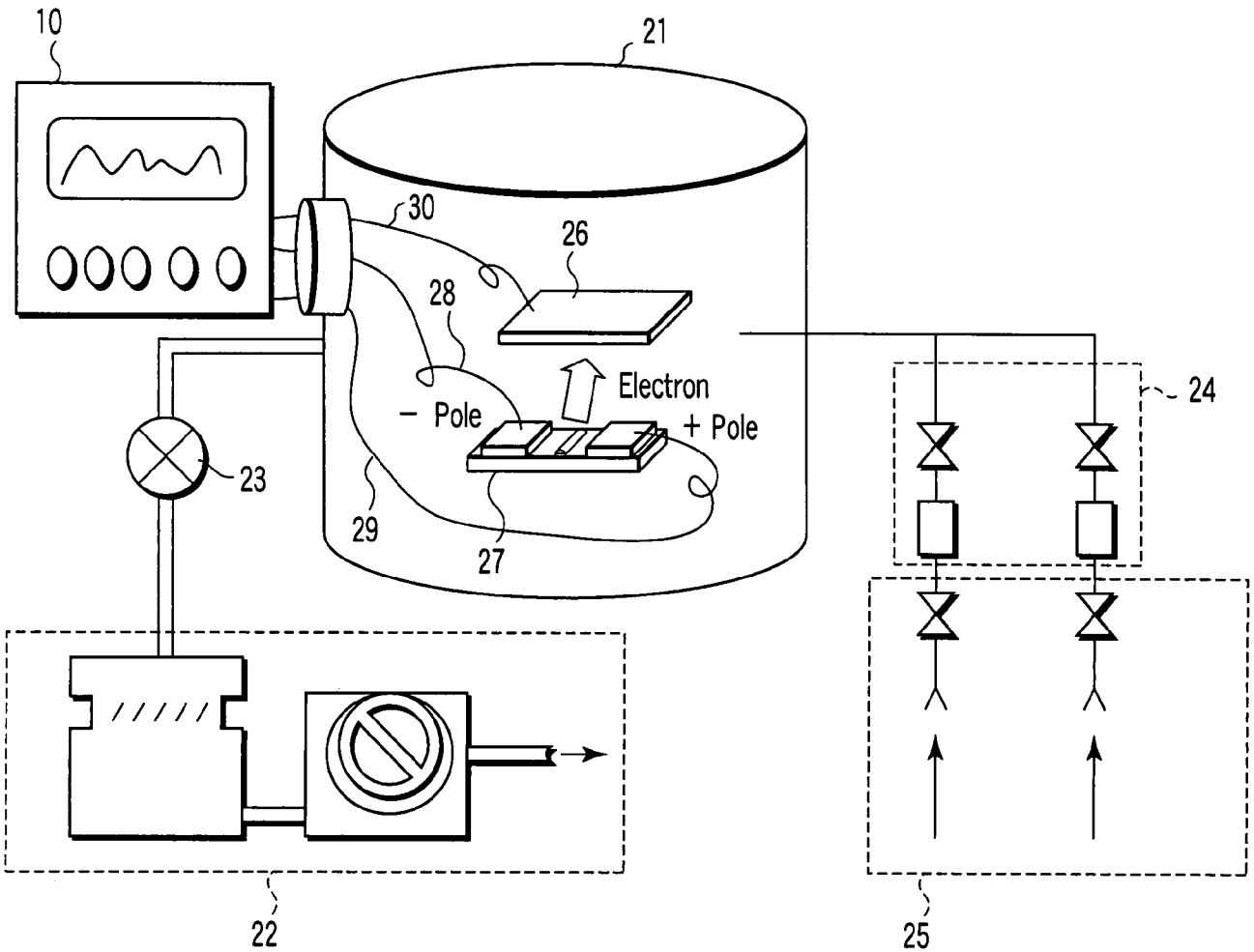
FIG. 3 is a diagram illustrating the structure of an apparatus to be employed in the formation of the deposits of a planar type electron emission device according to one embodiment of the present invention.

FIG. 3 shows the structure of the apparatus to be employed for forming the deposits 6. Referring to FIG. 3, a vacuum vessel 21 is connected via a gate valve 23 with an exhausting means 22 and also connected via a flow rate controlling means 24 with a raw material gas-feeding means 25. Inside the vacuum vessel 21, there are disposed an anode 26 and an device sample 27. The (−) side and (+) side of device electrodes of the device sample 27 and the anode 26 are respectively connected via wirings 28, 29 and 30 with a voltage-applying/-measuring means 10.

As for the vacuum vessel 21, it is possible to employ a metal chamber to be employed in an ordinary vacuum apparatus. The ultimate vacuum degree of the vacuum vessel 21 may preferably be $1\times10^{-7}$ torr or less, more preferably $1\times10^{-10}$ torr or less. The exhausting means 22 may preferably be an oil-free exhausting means. For example, it is possible to employ a magnetofloating turbomolecular pump, a diaphragm pump, a scroll pump, an ion pump, a titanium sublimation pump, a getter pump, sorption pump, or any suitable combination of these pumps.

The raw material gas-feeding means 25 is constituted by a vessel containing a raw material, a vessel temperature controlling mechanism for adjusting the vapor pressure of a raw material, and a primary pressure adjusting mechanism for a raw material gas. Irrespective of the kinds of a raw material (such as, liquid or solid) to be placed in the vessel, the temperature of the vessel as well as the primary pressure can be optionally adjusted. In order to enable a plurality of raw material gases to be supplied concurrently, the raw material gas-feeding means 25 may be arranged side by side in plural number.

As for the raw material gas, a raw material containing carbon atom is preferable, since such a raw material is capable of forming, as the deposits 6, a film containing carbon as a main component. As for the raw material containing carbon atom, it is possible to employ various kinds of materials comprising, as a basic component, aromatic hydrocarbon or chain hydrocarbon. It is possible to employ alcohol, phenol, thiol, ether, aldehyde, ketone, carboxylic acid, amine, etc.

Next, one preferable example of the process for forming the deposits 6 on the conductive thin films 4 and 5 by making use of the aforementioned means and materials will be explained.

Step 1:

As shown in FIG. 3, an device sample provided with the device electrodes 2 and 3, and the conductive thin films 4 and 5 is disposed inside the vacuum vessel 21. At this moment, the conductive thin films 4 and 5 are formed of a continuous film, and they are not yet electrically partitioned. Then, the device electrodes 2 and 3 are respectively connected with wirings 28 and 29, and the vacuum vessel 21 is exhausted.

Step 2:

Electric current flows through the conductive thin film electrically connected with the device electrodes 2 and 3, by means of the wirings 28 and 29. On this occasion, heat is permitted to generate in the conductive thin film, causing the thin film to locally flocculate and hence generating partially discontinuous portion in the thin film. The discontinuous portion is permitted to immediately enlarge, thus partitioning the conductive thin film into (+) side (4) and (−) side (5), thereby preventing the electric current from flowing. At this moment, the flowing of electric current is terminated.

Step 3:

The gas as a raw material for forming the deposits 6 is introduced into the vacuum vessel. Then, the flow rate and exhausting rate of the gas are adjusted to stabilize the pressure inside the vacuum vessel. The pressure inside the vacuum vessel can be measured using an ion gage for instance. Preferably, the composition of the gas species inside the vacuum vessel may be monitored and controlled by making use of a quadrupole mass spectrometer. The pressure inside the vacuum vessel depends on the activating gas to be employed and may be optionally selected from the range of $1\times10^{-1}$ to about $1\times10^{-8}$ torr.

Step 4:

By making use of voltage-impressing/measuring means 10, electric current flows through the device to thereby allow the raw gas to decompose due to the emitted electrons, electric field, heat, etc., thereby depositing deposits containing carbon originally contained in the raw gas on the thin films.

As for the voltage to be applied by means of the voltage-impressing/measuring means 10, it may be optionally selected from direct current, triangular wave, rectangular wave, pulsing wave, etc.

Step 5:

As the deposition of the deposits 6 is continued, the device current is proportionally increased. The supply of electric current is terminated as the device current is sufficiently increased. The judgment to terminate the supply of electric current can be made based on the magnitude of electric current required for the device or on the current-voltage characteristics.

Step 6:

After finishing the deposition of the deposit, the residual raw gas is sufficiently purged away to thereby inhibit any additional deposition and stabilize the characteristics of the device.

The step of forming the deposit on the thin film of the device may be repeated a plural number of times or may be performed in such a manner that films each differing in composition are alternately laminated one another.

According to one embodiment of the present invention, after finishing the formation of the device through the aforementioned step 6, the resultant device is further subjected to a treatment using plasma, thereby effecting the extension of the gap between the deposits on the cracked portion, thus permitting the device to be driven by a higher voltage and hence enabling to obtain a higher emission efficiency.

The deposit on the cracked portion are formed in such a manner that the voltage applied (activating voltage) and the gap between the deposits are equilibrated to each other in the steps 4 and 5. Namely, if a voltage which is larger than the activating voltage is applied to the cracked portion, the intensity of electric field to be generated in the cracked portion may exceed over the critical point, thus causing the discharge breakdown of the device (cracked portion). Therefore, in the case of the conventional planar type electron emitting device, the driving voltage is required to be set to not higher than the activating voltage. As a result, it has been impossible to obtain an emission efficiency which is higher than the value that will be given by the equilibrium state of the steps 4 and 5.

By contrast, in the case of the planar type electron emitting device according to one embodiment of the present invention, due to the plasma post-treatment which is applied to the deposits on the cracked portion, it is possible to form wide gap between the deposits on the cracked portion, the size of which goes beyond the that of the equilibrium condition, thereby making it possible to drive the device at a higher voltage than the activating voltage. It is known that the emission efficiency is strongly correlated with the initial velocity of electron to be emitted to the deposits on the cracked portion. In this case, since the initial velocity of electron can be represented by "Vf (voltage to be applied to the device)—Φ (surface work function)", it is now possible, through the application of a Vf value which is larger than the activating voltage, to obtain a higher emission efficiency which goes beyond the that of the equilibrium condition.

Next, the conditions for the plasma post-treatment according to one embodiment of the present invention will be explained.

As for the plasma post-treatment, it is possible to employ a method wherein the deposits on the cracked position are exposed to $N_2$ plasma for instance, thereby enabling the gap between the deposits on the cracked portion to extend larger than that can be obtained by the physical etching of the deposits on the cracked portion. Alternatively, it is also possible to employ a chemical plasma treatment such as RIE and CDE.

One of the advantages of the method using a chemical plasma treatment is the stabilization of the surface condition. As for the gas to be employed in the chemical plasma treatment, it is preferable to employ a halogen compound such as $CF_4$. According to a CDE treatment using $CF_4$, it is confirmed possible to form C—F bond, thereby making it possible to promote the stability of the surface of the device.

Figure 4:
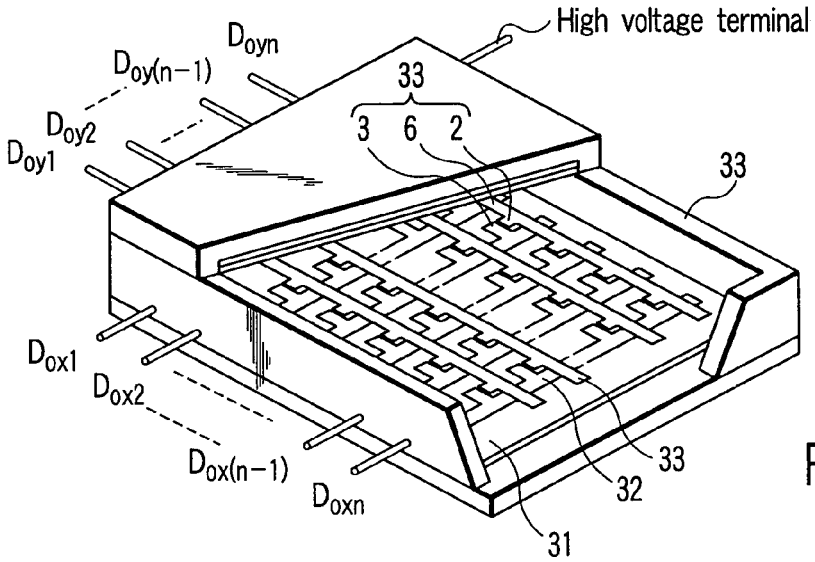
FIG. 4 is a perspective view illustrating generally the structure of an image display device provided with a plurality of the planar type electron emission devices according to one embodiment of the present invention.
Figure 5:
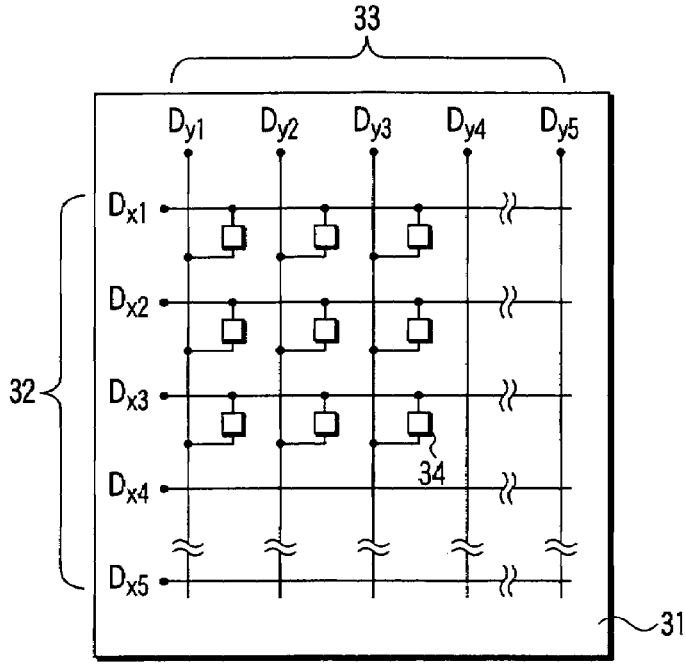
FIG. 5 is a diagram illustrating the circuit of the device shown in FIG. 4.

FIG. 4 schematically illustrates the structure of an image display device provided with a plurality of the planar type electron emission devices which are arranged in a form of matrix according to one embodiment of the present invention. FIG. 5 shows the circuit of the device shown in FIG. 4.

Referring to FIG. 4, X-orientated wirings 32 "m" in number, i.e. Dx1, Dx2, - - - Dxm and Y-orientated wirings 33 "n" in number, i.e. Dy1, Dy2, - - - Dyn are arrayed on the surface of the substrate 31, and a plurality of the planar type electron emission devices 34 are respectively electrically connected with these X-orientated wirings 32 and Y-orientated wirings 33. The image display device constructed in this manner is placed inside a housing 35.

Next, the present invention will be more specifically explained with reference to the following examples.

EXAMPLE 1

This example illustrates one example where the gap between the deposits on the cracked portion was extended by a treatment using plasma.

The electron emitting device that had been already subjected up to the aforementioned step 6 was placed in an apparatus of RIE (reactive ion etching) and subjected to an RIE treatment in a $N_2$ gas atmosphere. The conditions for this RIE were as follows.

Temperature of substrate: Room temperature
Pressure of $N_2$ atmosphere: $1\times10^{-2}$ torr
Power of plasma: 50 W
Duration of treatment: 30 seconds The measurement of the gap between the deposits on the cracked portion was performed by way of 1) direct observation by means of TEM; or by using 2) a calculated value that was obtained from the I–V characteristics which was measured assuming that the electric current flowing through the gap between the deposits on the cracked portion was the Fowler-Nordheim type current (F—N current). When the distribution in size of the gap of each of 5p devices was measured before and after the RIE treatment, the distribution thereof was 2.8–3.2 nm before the RIE treatment, whereas the distribution thereof was extended to 3.8–4.5 nm after the RIE treatment.

EXAMPLE 2

This example illustrates one example demonstrating that it was possible to obtain an electron emitting device which was capable of exhibiting high emission efficiency due to a treatment using plasma of a halogen compound. The processes involved herein will be explained by following the aforementioned device-forming processes.

The activating conditions of the aforementioned steps 3–5 were as follows. Namely, the gas employed in the activation was methane and the pressure thereof was $1\times10^{-6}$ torr. The activating voltage was 18V and a pulse of 1 ms was applied at a frequency of 30 hz. Further, the duration of activation was set to 120 minutes.

Subsequently, as a process corresponding to the step 6, the activating raw gas was sufficiently purged and then a heat treatment was performed for 6 hours at a substrate temperature of 200° C. The state of the device obtained from the treatments up to this moment was assumed as the device 1.

Next, the device 1 was subjected to an RIE treatment in a $CF_4$ gas atmosphere. The conditions for this RIE were as follows.

Temperature of substrate: 50° C.
Pressure of $CF_4$ atmosphere: $1\times10^{-2}$ torr
Power of plasma: 30 W
Duration of treatment: 20 seconds The state of the device obtained from the treatments up to this moment was assumed as the device 2.

By making use of these devices, the characteristics thereof were evaluated as follows. First of all, for the purpose of evaluating the upper limit of the voltage that can be applied to the device, a pulse voltage having a pulse width of 0.1 ms was applied to the device 1 at a frequency of 60 hz. On this occasion, the voltage to be applied to the device 1 was increased in stepwise by 0.5V, i.e. 17V, 17.5V, - - - . As a result, the destruction of the device was observed at 18.5V. The destruction of the device herein means a state wherein the device current is instantaneously diminished by about ½.

When the device which was destroyed in this manner was observed by means of an optical microscope, rib-like traces were found in the vicinity of the deposit on the cracked portion, indicating that discharge breakdown had been occurred at the cracked portion. As the margin is taken into account, the upper limit of the voltage that can be applied to the device would become about 17.5V, and the emission efficiency at this moment was found 0.08% as measured at an electric field strength of: anode voltage=1 kV/4 mm.

Figure 6:
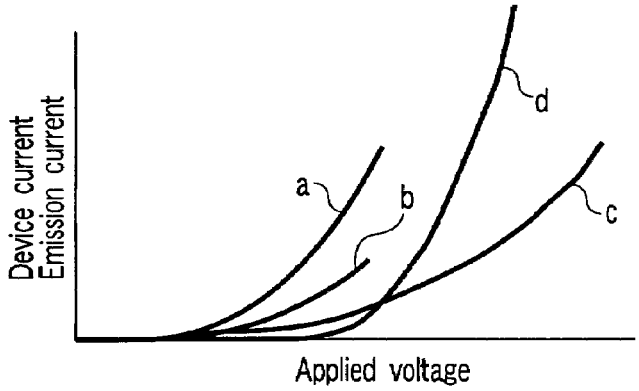
FIG. 6 is a graph illustrating the I–V characteristics of the device current and emission current of the devices 1 and 2 described in Example 2.

The same evaluation was performed with respect to the device 2, finding that the voltage required for destructing the device was 25V. It will be seen from the results that the upper limit of the voltage that can be applied to the device was increased due to the plasma treatment. Accordingly, when the emission efficiency of the device was measured under the same conditions as described above with the voltage of device being set to 23V, it was possible to obtain an emission efficiency of as high as 22%. FIG. 6 shows the I–V characteristics of the device current as well as the emission current of the devices 1 and 2. In FIG. 6, the curve "a" indicates the I–V characteristics of the device current of the device 1; the curve "b" indicates the I–V characteristics of the emission current of the device 1; the curve "c" indicates the I–V characteristics of the device current of the device 2; and the curve "d" indicates the I–V characteristics of the emission current of the device 2.

Then, the results obtained from the RIE treatment which was performed in a $N_2$ atmosphere were compared with the aforementioned results. In order to make the comparison between the kinds of plasma gases, the conditions of the RIE treatment were made the same as those of $CF_4$. It was found as a result of the evaluation of the upper limit of the voltage that can be applied to the device that the device was destroyed at a voltage of 22V. Accordingly, when the driving voltage was set to 21V, the emission efficiency in this case was 8%.

It will be recognized that even if it is possible, through the treatment utilizing plasma, to obtain a large degree of effects in improving the emission efficiency irrespective of the kinds of gas, it is preferable to employ a halogen compound as a gas source in the plasma treatment.

EXAMPLE 3

This example illustrates the results obtained through the observation of the state of chemical bond on the surface of the deposits which were subjected to plasma treatment. In this example, CDE (chemical dry etching) was performed as a plasma treatment. The conditions of the plasma treatment were as follows.

Figure 7:
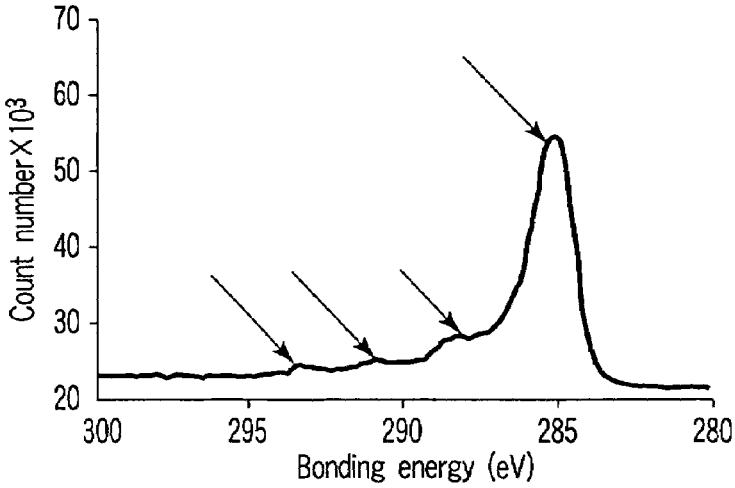
FIG. 7 is a graph illustrating the results of analysis of the surface bonding state which is measured using XPS (X-ray photoelectron spectrometry).

Temperature of substrate: Room temperature
Kind of gas: $CHF_3$
Pressure of gas: $5\times10^{-2}$ torr
Power of plasma: 80 W
Duration of treatment: 20 seconds As for the method of analysis of the state of chemical bond of the surface of deposit, XPS (X-ray photoelectron spectrometry) was employed. The results were as shown in FIG. 7. The peaks indicated by the arrows indicate the chemical bond of: C—H, C—F, C—$F_2$ and C—$F_3$ as mentioned from smaller side in energy-wise. It will be seen from these results that bonds between carbon and halogen (fluorine in this case) were formed on the surface of the deposits.

Further, this device was surface-etched by means of Ar ion sputtering and then evaluated by means of XPS in the same manner as described above. In this case, however, the chemical bonds of: C—F, C—$F_2$ and C—$F_3$ were not recognized. Namely, it will be seen that the aforementioned chemical bonds between carbon and halogen were formed not in the interior of the deposits but in the vicinity of the surface of the deposits.

The devices where the carbon-halogen bonds were recognized by means of XPS were further evaluated with respect to the emission efficiency thereof. As a result of the measurement which was performed under the conditions of: voltage applied to the device (Vf)=23V and anode voltage=1 kV/4 mm, an emission efficiency of 20% was obtained.

Incidentally, the present invention should not be construed as restricted to the aforementioned embodiments, but can be practiced by suitably modifying the constituent components without departing the gist of the invention. Further, various kinds of inventions will be realized through a suitable combination of the constituent devices disclosed in the aforementioned embodiments. For example, some of the constituent devices may be omitted from the entire constituent devices set forth in these embodiments. Alternatively, any of the constituent devices disclosed in different embodiments may be suitably combined with each other.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing a cold cathode type electron emitting device, comprising:

forming a pair of electrodes, which are spaced from each other, on a substrate;

forming conductive thin films, which are electrically connected with said pair of electrodes and have a cracked portion therebetween, on a space between said pair of electrodes;

forming conductive deposits on the cracked portion of the conductive thin films to form an electron emission section; and subjecting said electron emission section to a treatment using plasma to expand a gap between the conductive deposits on the cracked portion.

2. The method according to claim 1, wherein said treatment using plasma is reactive ion etching or chemical dry etching.

3. The method according to claim 1, wherein a gas source of said plasma is a gas containing a halogen compound, and said electron emission section has a carbon-halogen bond in a vicinity of a surface thereof.

4. The method according to claim 3, wherein said halogen compound is at least one compound selected from the group consisting of chloromethane, fluoromethane, chlorofluorocarbon and halon.

5. The method according to claim 1, wherein said chloromethane is at least one compound selected from the group consisting of carbon tetrachloride ($CCl_4$), chloroform ($CHCl_3$), methylene chloride ($CH_2Cl_2$), trichloroethylene ($C_2HCl_3$) and tetrachloroethylene ($C_2Cl_4$); said fluoromethane is at least one compound selected from the group consisting of carbon tetrafluoride ($CF_4$), trifluoromethane ($CHF_3$), methylene fluoride ($CH_2F_2$) and tetrafluoroethylene ($C_2F_4$); said chlorofluorocarbon is at least one compound selected from the group consisting of $CCl_3F$, $CCl_2F_2$, $CF_3CHCl_2$ and $CF_3CH_2Cl$; and said halon is at least one compound selected from the group consisting of $CBrClF_2$ and $CBrF_3$.

6. The method according to claim 5, wherein said halogen compound is $CF_4$ and said electron emission section has, in a vicinity of a surface thereof, at least one bond selected from the group consisting of C—F, C—$F_2$ and C—$F_3$.

7. The method according to claim 1, wherein a gas source of said plasma is $N_2$.

8. The method according to claim 1, wherein said gap between said deposits on said cracked portion is extended by about 0.5 nm or more and 1.0 nm or less as a result of said treatment using plasma.

9. The method according to claim 1, wherein said pair of electrodes comprise a transition metal selected from the group consisting of Ni, Au, Ag, Pt and Ir.

10. The method according to claim 1, wherein said conductive thin film comprises a transition metal selected from the group consisting of Ni, Co, Fe, Pd, Au, Pt and Ir.

11. The method according to claim 1, wherein said conductive deposits comprise carbon and are formed by flowing electric current between said pair of electrodes in a gas atmosphere containing carbon atom.

12. The method according to claim 11, wherein said gas atmosphere containing carbon atom comprises at least one compound selected from the group consisting of alcohol, phenol, thiol, ether, aldehyde, ketone, carboxylic acid and amine.

* * * * *